US005468939A

United States Patent [19]

MacLean, IV

[11] Patent Number: 5,468,939

[45] Date of Patent: Nov. 21, 1995

[54] MICROWAVE COOKING CONTAINER WITH REFLECTORS

[76] Inventor: John A. MacLean, IV, 11428 N. Vega Ave., Mequon, Wis. 53092

[21] Appl. No.: 270,024

[22] Filed: Jul. 1, 1994

[51] Int. Cl.[6] ..... H05B 6/80

[52] U.S. Cl. ..... 219/727; 219/728; 426/107; 426/234; 99/DIG. 14

[58] Field of Search ..... 219/725, 728, 219/729, 727, 734, 735; 426/107, 234, 113, 243, 118; 99/DIG. 14

[56] References Cited

U.S. PATENT DOCUMENTS

| | | | |
|---|---|---|---|
| 2,920,804 | 1/1960 | Minton | 229/1.5 |
| 3,865,301 | 2/1975 | Pothier et al. | 219/729 |
| 3,873,738 | 3/1975 | Zoeller et al. | 426/111 |
| 4,015,085 | 3/1977 | Woods | 219/729 |
| 4,038,425 | 7/1977 | Brandberg et al. | 426/107 |
| 4,219,573 | 8/1980 | Borek | 426/107 |
| 4,277,506 | 7/1981 | Austin | 426/111 |
| 4,292,332 | 9/1981 | McHam | 426/111 |
| 4,448,309 | 5/1984 | Roccaforte et al. | 206/525 |
| 4,450,180 | 5/1984 | Watkins | 426/107 |
| 4,495,392 | 1/1985 | Derby | 219/728 |
| 4,553,010 | 11/1985 | Bohrer et al. | 219/730 |
| 4,584,202 | 4/1986 | Roccaforte | 426/111 |
| 4,626,641 | 12/1986 | Brown | 219/728 |
| 4,642,434 | 2/1987 | Cox et al. | 219/728 |
| 4,656,325 | 4/1987 | Keefer | 219/728 |
| 4,734,288 | 3/1988 | Engstrom et al. | 426/107 |
| 4,806,371 | 2/1989 | Mendenhall | 426/113 |
| 4,808,421 | 2/1989 | Mendenhall et al. | 426/107 |
| 4,820,893 | 4/1989 | Mode | 426/107 |
| 4,892,744 | 1/1990 | Ylvisaker | 426/111 |
| 4,904,487 | 2/1990 | LaBaw et al. | 426/107 |
| 4,938,373 | 7/1990 | McKee | 220/23.86 |
| 5,171,594 | 12/1992 | Babbitt | 426/107 |

FOREIGN PATENT DOCUMENTS 710528 8/1931 France .

*Primary Examiner*—Philip H. Leung
*Attorney, Agent, or Firm*—Michael Best & Friedrich

[57] ABSTRACT

A container for popping popcorn in a microwave oven includes bottom, front, side rear and top walls which are generally rectilinear and define an interior space for containing the popcorn. The container is formed of a cardboard material, and the side walls are collapsible inwardly to permit the container to collapse when pressure is applied to its bottom and top walls and to expand to define the interior space when pressure is applied to the junction of the rear wall and one of said top and bottom walls and the junction of the front wall and the other of the top and bottom walls. A material which reflects microwaves is disposed on the bottom wall and on a strip at the lower edges of the front rear and side walls.

17 Claims, 5 Drawing Sheets

20
38
34
32
23
36
18

38
16
32
42
43
34
23
12
14
36

MICROWAVE COOKING CONTAINER WITH REFLECTORS

BACKGROUND OF THE INVENTION

This invention relates to microwave cooking containers.

Microwave ovens are essentially heaters employing a magnitron which radiates electromagnetic energy in short radio frequencies. The energy waves are distributed randomly throughout the oven and are reflected and re-reflected from its inner surfaces inwardly until absorbed by the product being heated. Such repeated reflections and the interference between waves results in some energy loss.

Prior art microwave cooking containers are generally transparent to microwave energy to permit the interior of the food product to be heated through direct microwave absorption. This stimulates high frequency oscillations that cause molecular friction to generate heat. Such direct heating of high moisture food products is limited to about 100° C. at which point, the water content begins to vaporize. Upon reaching vaporization, such water molecules move through the product and disburse in the ambient atmosphere where a portion condenses on the surface of the food product. This precludes browning or crisping and makes the food product soggy.

In order to elevate the cooking temperature above 100° C., some prior art microwave cooking containers are provided with a microwave energy absorbing material which are commonly referred to as susceptors. These materials or susceptors are generally located in the lower end of the package and heat the food product by conduction and radiation.

Prior art microwave cooking containers having susceptors were not wholly satisfactory because they tended to heat unevenly resulting in hot spots that can cause the container and/or the food product to overheat. This resulted in uneven heating and sometimes caused burning of the susceptor which imparted a bad flavor to the food and inconsistent or uneven heating. Moreover, such overheating can dry out or overcook the food product in random, spotty zones. Also, because the heat is transferred from the susceptor to the food product by conduction as well as radiation, the food product, in effect, acts as a heat sink for the susceptor. As a result, the food product must be placed in close contact with the susceptor to avoid localized overheating. This is a particular problem when cooking food products which are irregularly shaped or are non-uniform in density. Heated susceptors also presented a safety hazard to users requiring some degree of caution.

One type of prior art microwave cooking container comprises a bag or pouch containing unpopped popcorn and hydrogenated cooking fat. A susceptor in the bottom of the bag or pouch becomes heated as it absorbs microwave radiation. The heat is conducted upwardly into the popcorn kernels. As the corn heats, water stored in the kernels vaporizes causing the internal pressure to rise until the outer shell or pericarp of the kernel ruptures explosively. The bag or pouch is constructed to permit expansion under the influence of the internal vapor pressure to accommodate the increase in volume as the corn pops.

The expanding bag or pouch also provides relatively nonplanar surfaces which do not readily reflect the microwave radiation within the oven. Until the microwaves are absorbed by the susceptor or the corn to be popped, they are reflected from the internal surfaces of the oven and collide with other reflective rays thereby losing some of their energy. This delays the cooking time and permits the corn kernels to lose some of their heat between impacts of microwave radiation. Also, because the corn is heated primarily from below by the susceptor, localized hot spots are created which results in a high proportion of unpopped kernels.

Also, because the heat absorbed by a body is directly related to its size, only the largest size kernels were employed for microwave popcorn. This limited the varieties of popcorn which could be employed.

Cooking oil accounts for about 97% of the fat content in microwave popcorn. Because expandable prior art microwave popcorn containers were sealed, it was not possible for the consumer to reduce the fat or salt content. This made the product unsuitable for persons on low fat or low salt diets. Such sealed packages were also unsatisfactory because they did not permit steam to escape so that the popcorn tended to be soggy.

SUMMARY OF THE INVENTION

It is an object of the invention to provide a new and improved microwave cooking container.

Another object of the invention is to provide a microwave cooking container that heats food more evenly.

A further object of the invention is to revise a microwave cooking container wherein the formation of hot spots in the container or the food being heated are minimized.

Yet another object of the invention is to provide a microwave cooking container which is relatively energy efficient.

A still further object of the invention is to provide a container for microwave cooking in which the food is brought to the desired temperature more rapidly for a given energy input.

It is a further object of the invention to provide a microwave popcorn container in which the level of fat and/or salt in the popped corn can be controlled.

Another object of the invention is to provide a microwave cooking container which permits steam to be vented.

A further object of the invention is to provide a microwave cooking container which can more uniformly heat food products having an irregular shape or uneven density.

A still further object of the invention is to provide a microwave cooking container which is relatively safe to use.

These and other objects and advantages of the instant invention will become more apparent from the detailed description thereof taken with the accompanying drawings.

In general terms, the invention comprises a microwave cooking container having bottom, side, front, rear and top walls which define an interior space and reflecting means disposed on at least a portion of said side and bottom walls for reflecting microwave radiation inwardly toward said interior space.

According to a more specific aspect, the invention comprises a container for popping popcorn in a microwave oven and including bottom, front, side rear and top walls which are generally rectilinear or are moderately concave or convex and define an interior space for containing the popcorn. The container is formed of a cardboard material, with the side walls being collapsible inwardly to permit the container to collapse when pressure is applied to its bottom and top walls and to expand to define the interior space when pressure is applied to the junction of the rear wall and one of said top and bottom walls and the junction of the front wall and the other of the top and bottom walls.

DETAILED DESCRIPTION OF THE PREFERRED EMBODIMENT

Figure 2:
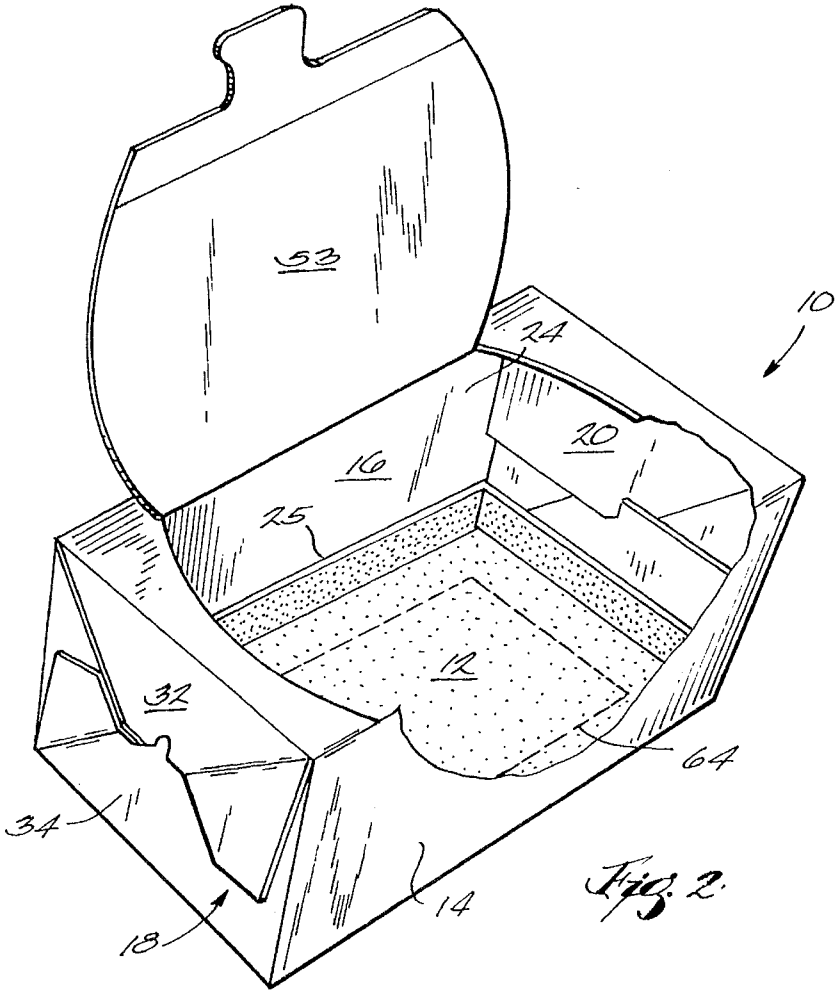
FIG. 2 is a perspective view showing the container of FIG. 1 with parts broken away.
Figure 1:
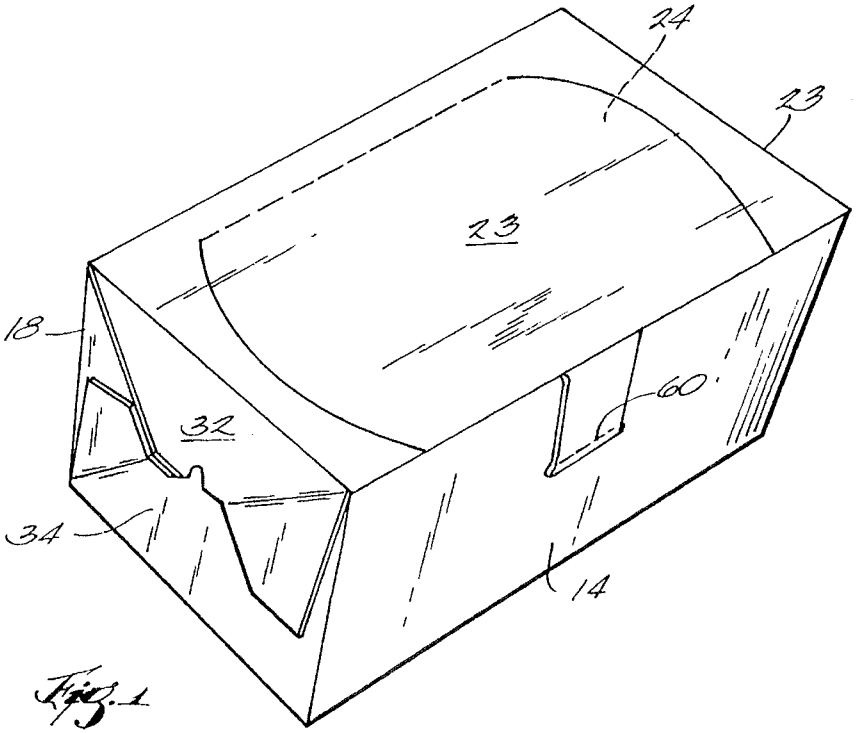
FIG. 1 is a perspective view showing the microwave cooking container according to the preferred embodiment of the invention.

FIGS. 1 and 2 show a microwave cooking container 10 according to the invention for use in popping popcorn, although it will be appreciated that the invention has application to the cooking of other food products as well. The container 10 is collapsible and is shown in FIGS. 1 and 2 in its extended condition. The container 10 is generally a rectangular box having a bottom wall 12, a front wall 14, a rear wall 16, side walls 18 and 20, and a top wall 23. This defines a space 24 for containing a food product, such as popcorn, to be heated. The container may be formed of any suitable material such as paper board or corrugated flute paper board. In addition, there is a ply of a microwave radiation reflecting material 25 which covers the bottom wall 12 and the lower portions of the front, rear and side walls, 14, 16, 18 and 20. The material 25 forms an arrayed microwave reflector (AMR) which redirects and focuses microwave energy back into the internal portions of the product in a relatively uniform manner. As a result, there is no need for the package to be in contact with the food article so that relatively odd shaped food will cook more uniformly. This minimizes the formation of hot spots and requires less care in-placing the food product within the container. Moreover, because steam is not needed to expand a collapsed pouch thorough venting of the package is possible so that the likelihood that the food product will become soggy is reduced. In the preferred embodiment, the material extends about one quarter of the way up from the lower edges of the walls 14, 16, 18 and 20. This would be about one inch for a box four inches in height.

The material 25 may be formed by laminating Vacumet metallized polyester films, 48 gauge to supercalendared paper for support. While this material has been used for susceptors in the past, the metallized layer of the material 25 has an optical density of about 2.0 which is about 6 to 10 times greater than that previously employed. Other microwave reflective materials may be reflective nontoxic inks printed directly on the surfaces of the cardboard container or a metallic foil. For even more focused reflections, materials may be employed which are holographically etched or engraved to provide microwave reflecting and focusing elements.

In the preferred embodiment of the invention, the material 25 consists of microwave reflective particles deposited on a plastic film such as polyester or thin paper which is either laminated directly to paperboard or flexible films or adhesively attached to a rigid or semi-rigid area in or on the container in the process accomplished in existing "windowing" or patterned glue converting equipment. When the windowing option is selected, the contiguous substrate of the AMR surface carries and attaches the AMR on more than one plane and the substrate can further be adhesively attached so that the corners which are created at the intersection of two or more planes can be bridged whereby the internal or external folded intersections of the package can be curved to either relatively large or small radiuses or in combinations to create surfaces which are convex or concave or both whereby the radiation is focused toward a particular part of the package to enhance energy transmission to the product. Concave and convex and planar surfaces can be created externally and internally through other supporting means in a manner well known in the art.

At the intersection of three planes in the foldable carton, a corner is usually created that will leak some fluids, especially oils and gases. The flexible "window" attachment of an impervious substrate can close these leak spots so that any cooking oil used in the popping of popcorn for example, will be retained within the package.

Figure 3:
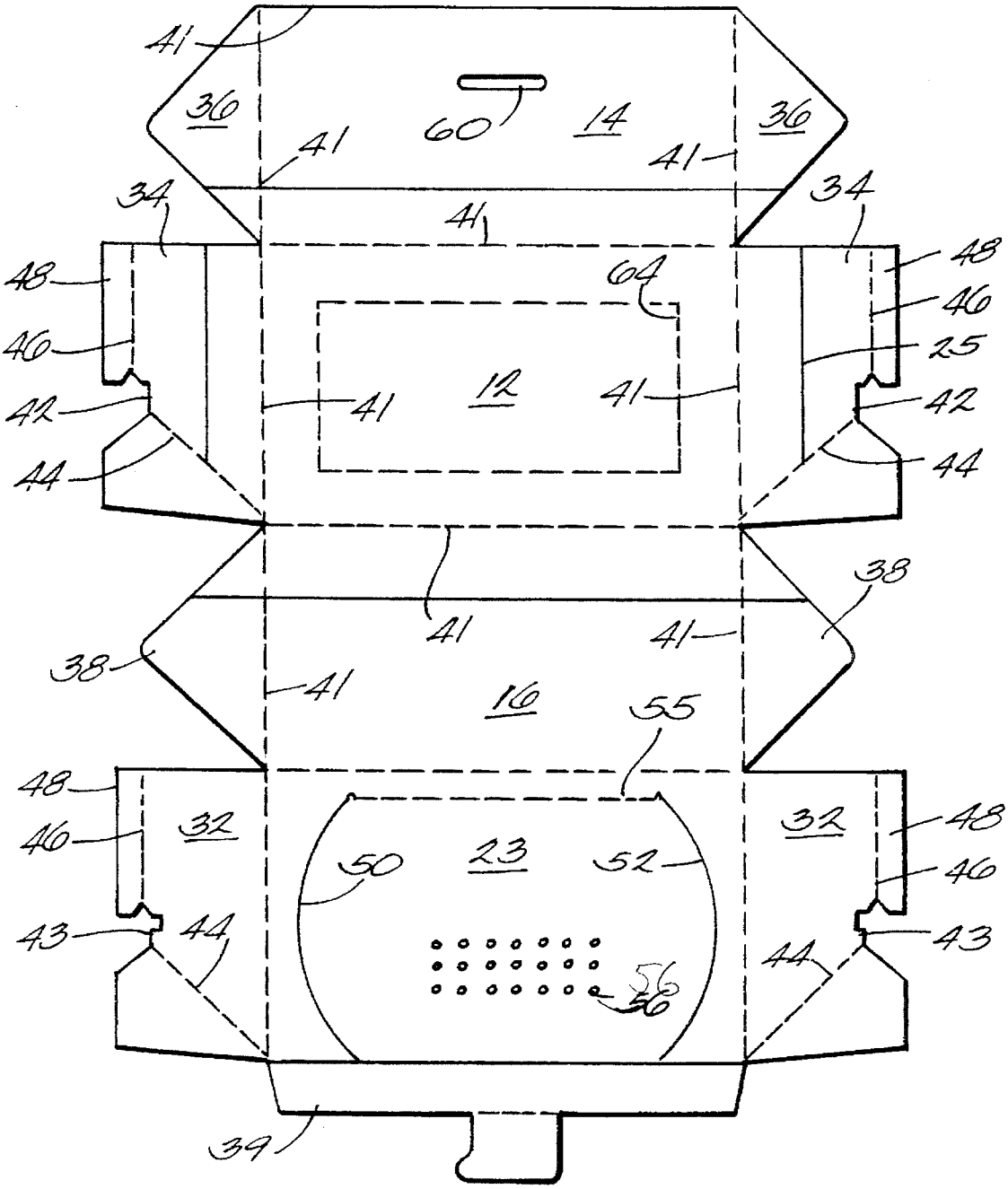
FIG. 3 shows the blank from which the container of FIG. 1 is formed.

FIG. 3 shows the blank 30 from which the container of FIGS. 1 and 2 is formed. Those portions of the blank 30 which define the bottom, front, and rear walls 12, 14 and 16, respectively, and top wall 23 are indicated by corresponding reference numerals in FIG. 3. The side walls 18 and 20 are each formed by generally rectangular upper segments 32 extending laterally from the opposite sides of the top wall 23 and generally rectangular lower segments 34 extending laterally from the opposite sides of the bottom 12. A first pair of generally triangular flaps 36 extend laterally from the opposite sides of the front wall 14 and a second pair of generally triangular flaps 38 extend laterally from the opposite sides of the rear wall 16. Finally, flap 39 extends from the front edge of the top wall 23 and a catch 40 is provided at its center. Creases 41 are formed between all of the components discussed above to facilitate uniform bending of the components inwardly to form the container 10.

A notch 42 is formed in each of the outer edges of the side wall portions 34 and similarly shaped notches 43 are formed in the outer edges of each of the upper side wall segments 32. In addition, creases 44 are formed diagonally in each of the wall segments 32 and 34 from one corner to the notches 42 or 43. Creases 46 are also formed in the edges of each of the side wall segments 32 and 34 and in general parallelism with the edge to define flaps 48.

The top wall 23 is slit at 48 along its forward edge and rewardly in generally arcuate paths 50 and 52 to form a lid 53 which is pivotable along a rear crease 54. There are also a plurality of vent openings 56 in the center of each side of the lid 52. The vent opening 56 permits steam released by the popped corn kernels to vent but prevent the escape of exploding corn kernels. A catch 59 is formed on one side of the top wall 23 for engaging a slot 60 is formed in the front wall 14 for retaining the lid 53 in a closed position.

A rectangular ridge 64 may be formed at the center of the bottom 12 to define a shallow dam for retaining cooking oil.

The container is formed by gluing each of the flaps 36 to the side wall portions 32 with the edges of the flaps 36 coinciding with the creases 44 and similarly, the flaps 38 are glued to the side wall portions 34 with the edges of the flaps 38 coinciding with the creases 44 in side wall portions 34. In addition, the flap 39 is glued to the upper edge of the front wall 14. Finally, each of the flaps 48 is folded inwardly and glued to the side wall portions 32 or 34.

Figure 4:
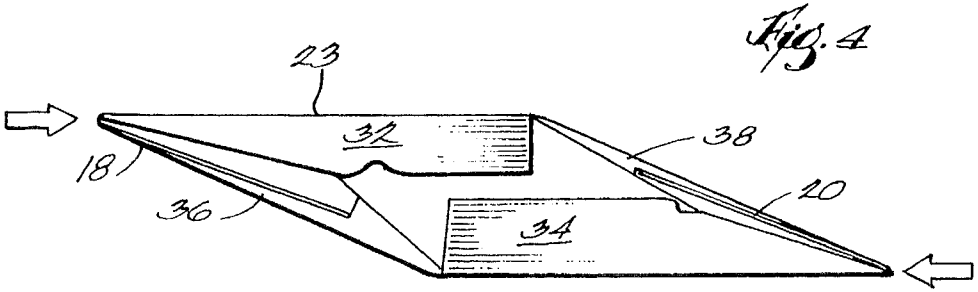
FIG. 4 is a side view showing the container of FIG. 1 in a partially collapsed state.
Figure 5:
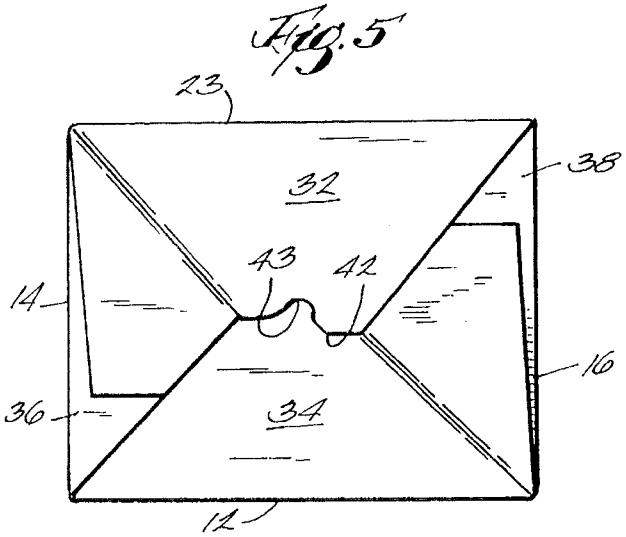
FIG. 5 is a side view of the container shown in FIG. 1.

Initially, the container 10 is shipped in a collapsed state and is wrapped in a plastic outer film (not shown). Inside the collapsed container is a quantity of cooking oil, salt and unpopped popcorn which may be contained in separate plastic pouches. The container is expanded as shown in FIG. 4 from its collapsed state to its expanded state shown in FIGS. 1 and 2 by pushing inwardly on each of its front and rear edges. As the container reaches its fully extended condition, the notches 42 and 43 interlock as shown in FIG. 5 to restrain the Container from collapsing. The cooking oil, salt and unpopped popcorn may then be discharged into the container 10 for insertion in a microwave oven. However, if the user is on a low fat or low salt diet, the cooking oil and/or the salt may be omitted.

In the packaging process, the collapsed containers may be moved along a conveyor in a vertical orientation. Pressure is then applied to the opposite ends as viewed in FIG. 4 and at the upper portion thereof to spread this side wall segments 32 and 34. This permits the pouches of popcorn, oil and salt to be dropped vertically through the top opening while the side wall portions 32 and 34 at the opposite sides will prevent the pouches from passing through. The packages containing the popcorn, oil and salt may then be wrapped for shipment.

The reflective material 25 disposed below and along the sides of the food being heated intercepts stray microwave radiation and reflects the same back onto the food material. This effectively reduces the volume of the microwave oven to that of the container which is the optimal size for heating the particular food product, such as popcorn, for example. In other words, instead of passing through the container 10 for reflection by the walls of the microwave oven, stray microwaves are reflected by the material 25 into the food product. This reduces haphazard reflection of the microwave radiation which is otherwise converted to wasted heat in the walls of the oven.

Because the surfaces defined by the reflective material 25 are generally planar or slightly concave or convex, they readily intercept and reflect microwave radiation. As a result, there is a higher probability that stray microwave radiation will be reflected backwardly toward the food product located within the container. These reflected waves are intercepted by the food product while they are at a high energy level and are converted to useful heat. As a result, the food product reaches a desired temperature at a faster rate because the reflective radiation is at a higher energy level than waves which have reflected repeatedly off the walls of the microwave oven. Also because the time between which food product is impacted by radiation is reduced, the loss of heat between impacts is also reduced. Moreover, by surrounding the food product with reflective material 25, heating is more uniform thereby minimizing the formation of hot spots in the container and the food product.

Figure 6:
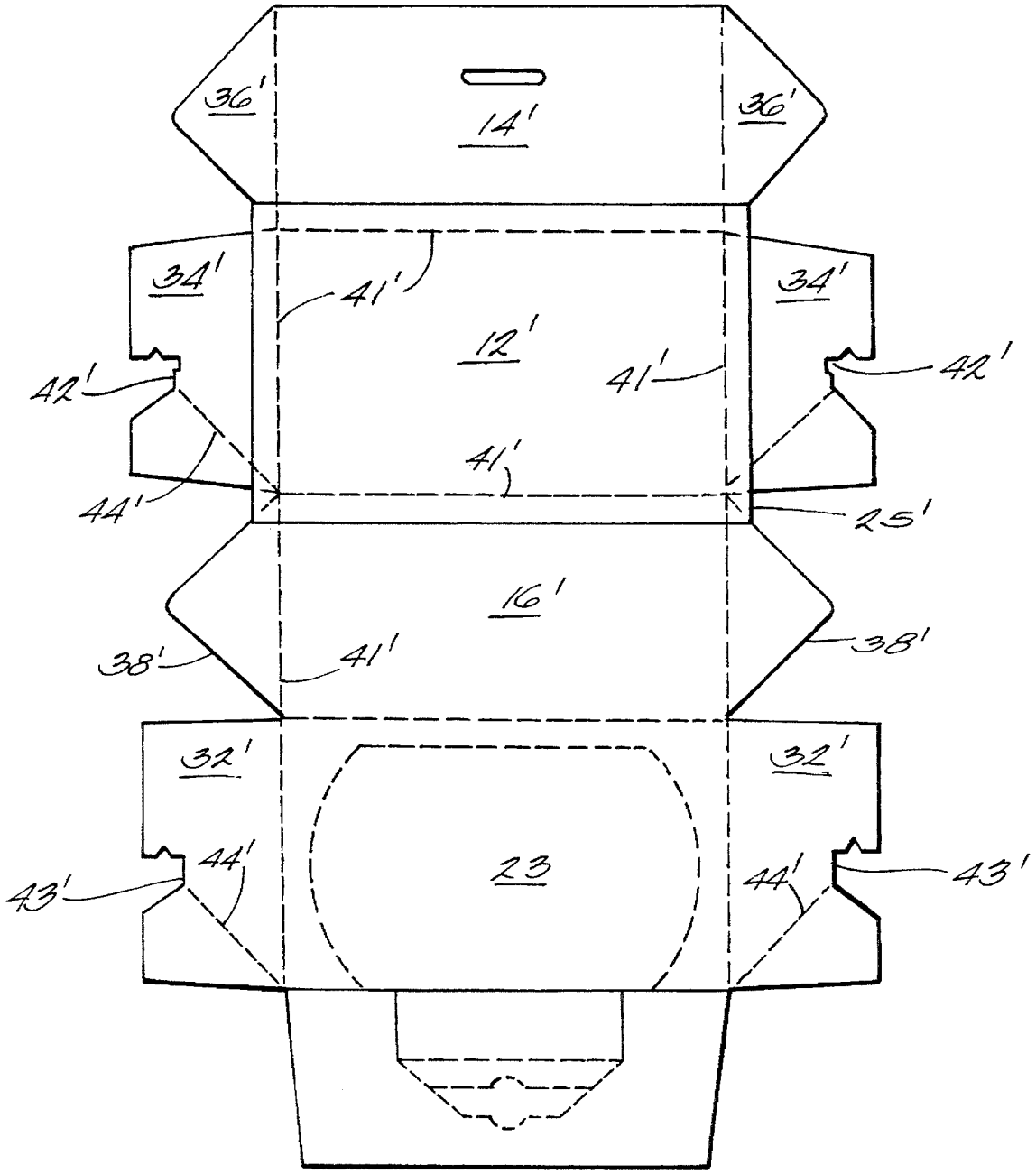
FIGS. 6 and 7 show alternate embodiments of the invention.

FIG. 6 shows a blank 10' for the preferred embodiment of the invention which includes the same general components as the blank illustrated in FIG. 3 and corresponding parts have been identified with the same reference numerals but which are distinguished by a prime (′). The primary differences between the blank 10' of FIG. 4 and that of FIG. 3 is in the configuration of the notches 42' and 43'. In addition, the reflective materials 25, consists of a rectangular sheet which covers the entire bottom 12' and extends upwardly along the lower portions of the wall 14', the rear wall 16' and the side wall portions 34'. Accordingly, when the blank 10' is folded along the creases 41' and 44' to form the container, the reflective material 25' will form a continuous pan for holding cooking oil and the food to be heated. This will normally prevent the oil from leaking at the corners.

The package is assembled by gluing the triangular flaps 36' to the side wall portions 32' and the flaps 38' to the side wall portions 34' with the edges of the flaps 36' and 38' lying along the creases 44'.

Figure 7:
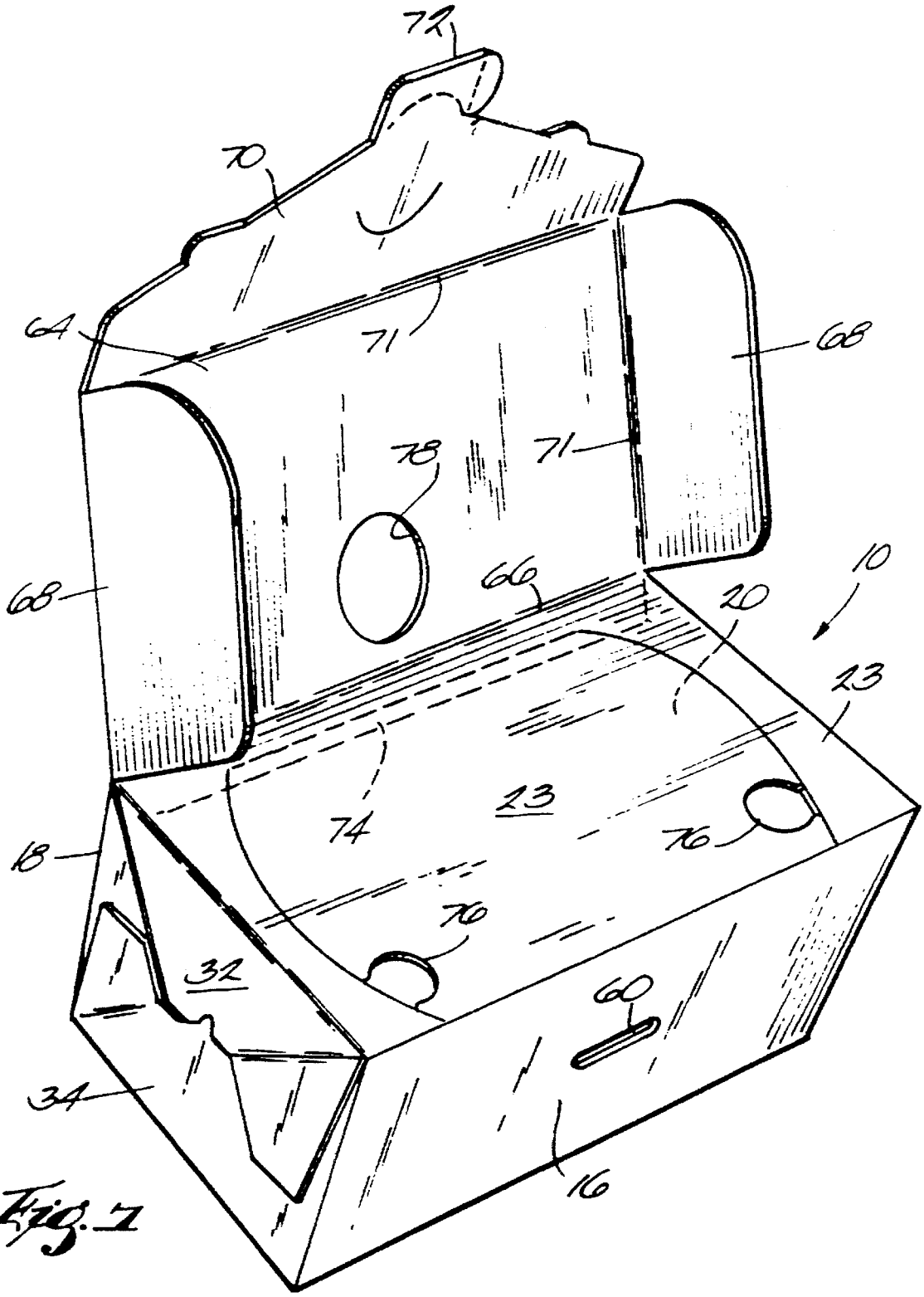

FIG. 7 shows an alternative embodiment of the invention which is similar to that shown in FIGS. 1–5 except that a cover 64 is provided. The cover 64 is fixed to the edge 66 of the rear wall 14 and includes a pair of side panels 68 and an end flap 70 having a tab 72 which is receivable within the slot 60. The end panel 68 and the tab 70 are hingedly connected to the cover 64 by creases 71.

One or more vent openings 76 may be provided in the top wall 23 and a vent opening 78 may be provided in the cover 64. Preferably, the vent openings 76 and 78 are out of alignment so there is no direct path for the popcorn to escape the container when it is being popped. The cover 64 permits the container to be reclosed for later use once the top wall is opened.

While only a few embodiments of the microwave cooking container according to the invention has been illustrated, those skilled in the art will appreciate that the container may take various forms. Moreover, while the specific embodiments are intended to be used for popcorn, various other food items may also be heated in containers according to the invention. Accordingly, the invention is not intended to be limited to the illustrated embodiments but only by the scope of the appended claims.

I claim:

1. A microwave cooking container having bottom, side, front, rear and top walls, the bottom wall of said container and the lower portions of the side, front and rear walls defining a food receiving space in the lower portion of the container, the upper portion of the container defining a food expansion space to accommodate expansion of the food product as a result of the heating thereof, means disposed on the bottom wall and along the lower portion of each of the front, rear and side walls for reflecting microwave radiation inwardly toward said food receiving space, the top wall and the upper portions of said side, front and rear walls being free of said means for reflecting, whereby microwave radiation may pass through the top wall and the upper portions of the side, front and rear walls for impacting said food receiving space and microwave radiation impacting the means for reflecting is reflected back into the food receiving space.

2. The microwave cooking container set forth in claim 1 wherein said means for reflecting comprises a reflective material, the bottom wall and the side, front and rear wall portions which support said means for reflecting being generally rectilinear, said side, front and rear wall portions being generally perpendicular to said bottom wall.

3. The container set forth in claim 2 wherein said bottom; front, rear, side and top walls are formed of a cardboard material, said side walls being collapsible inwardly to permit said container to collapse when pressure is applied to its top and bottom walls and to expand to define the interior space when pressure is applied to the corner of the rear wall and one of said top and bottom walls and the corner of the front wall and the other of said top and bottom walls.

4. The container set forth in claim 3 wherein said side walls are defined by an upper part fixed to the top wall and a bottom part fixed to the bottom wall and foldable means between said upper part and the top wall and the bottom part and the bottom wall, said parts cooperating to form said side wall when said container is expanded to define said interior space.

5. The container set forth in claim 4 and including engageable means on said upper and lower parts for retaining said parts in engagement when said container is expanded.

6. The container set forth in claim 1 wherein said reflecting means covers approximately one quarter of the lower portion of each of said front, rear and side walls.

7. The container set forth in claim 1 wherein said top wall has a lid which is pivotal between open and closed positions, said lid having at least one vent opening and a cover pivotally mounted on the container for covering said upper wall and means for retaining said cover in a closed position.

8. The container set forth in claim 7 wherein said cover includes a vent opening displaced from the vent openings of said lid.

9. A container for popping popcorn in a microwave oven and including bottom, front, side and top walls, the bottom of said container and the lower portions of the side, front and rear walls defining a popcorn receiving space in the lower portion of the container, the upper portion of the container defining an expansion space to accommodate the popped popcorn result of the heating thereof, means disposed on the bottom wall and along the lower portions of each of said front, rear and side walls for reflecting microwave radiation inwardly toward the popcorn disposed in said receiving space, the top wall and the upper portions of said side, front and rear walls being free of said means for reflecting so that microwave radiation passes therethrough.

10. The container set forth in claim 9 wherein said means for reflecting comprises a reflective material, said side, front and rear walls being substantially perpendicular to said bottom wall, said side walls being collapsible inwardly to permit said container to collapse when pressure is applied to its bottom and top walls and to expand to define the interior space when pressure is applied to the junction of the rear wall and one of said top and bottom walls and the junction of said front wall and the other of said top and bottom walls.

11. The microwave cooking container set forth in claim 10 wherein said reflecting mean; comprises a reflective material disposed on the bottom wall and a strip of said material is disposed along a lower portion of each of said front rear and side walls, the top wall and the upper portions of said side, front and rear walls being free of said reflective material.

12. The container set forth in claim 11 wherein said side walls are defined by an upper part fixed to the top wall and a bottom part fixed to the bottom wall and foldable means between said upper part and the top wall and the bottom part and the bottom wall, said parts cooperating to form said side wall when said container is expanded to define said interior space.

13. The container set forth in claim 12 and including engageable means on said upper and lower parts for retaining said parts in engagement when said container is expanded.

14. The container set forth in claim 13 wherein said reflective material covers approximately one quarter of the lower portion of each of said front, rear and side walls.

15. The container set forth in claim 14 wherein said top wall has a lid which is pivotal between open and closed positions, said lid having at least one vent opening and a cover pivotally mounted on the container for covering said upper wall and means for retaining said cover in a closed position.

16. The container set forth in claim 15 wherein said cover includes a vent opening displaced from the vent opening of said lid.

17. The container set forth in claim 16 and including means formed on the bottom wall for defining a shallow well for receiving cooking oil.

* * * * *